US008764233B2

(12) United States Patent
Kurkofka et al.

(10) Patent No.: US 8,764,233 B2
(45) Date of Patent: Jul. 1, 2014

(54) STREET LIGHTING DEVICE AND INSTALLATION METHOD

(75) Inventors: Waldemar Kurkofka, Rheda-Wiedenbrück (DE); Alfons Puls, Soest (DE)

(73) Assignee: Hella KGAA Hueck & Co, Lippstadt (DE)

( * ) Notice: Subject to any disclaimer, the term of this patent is extended or adjusted under 35 U.S.C. 154(b) by 89 days.

(21) Appl. No.: 13/458,231

(22) Filed: Apr. 27, 2012

(65) Prior Publication Data

US 2013/0114259 A1 May 9, 2013

Related U.S. Application Data

(63) Continuation of application No. PCT/EP2010/065604, filed on Oct. 18, 2010.

(30) Foreign Application Priority Data

Oct. 27, 2009 (DE) ..... 10 2009 050 876

(51) Int. Cl.
*F21S 4/00* (2006.01)

(52) U.S. Cl.
USPC ..... 362/249.01; 362/235

(58) Field of Classification Search
USPC ..... 362/249.01–249.03, 235, 373
See application file for complete search history.

(56) References Cited

U.S. PATENT DOCUMENTS

| | | | | |
|---|---|---|---|---|
| 6,840,654 | B2 | 1/2005 | Guerrieri et al. | |
| 7,374,322 | B2 | 5/2008 | Steen et al. | |
| 7,857,497 | B2 | 12/2010 | Koike et al. | |
| 2008/0151545 | A1 * | 6/2008 | Kratz | 362/249 |
| 2008/0298062 | A1 | 12/2008 | Wang | |
| 2009/0034257 | A1 | 2/2009 | Liu et al. | |
| 2009/0237927 | A1 | 9/2009 | Zheng et al. | |
| 2009/0316403 | A1 * | 12/2009 | Zhang et al. | 362/249.01 |

FOREIGN PATENT DOCUMENTS

| | | | |
|---|---|---|---|
| DE | 1620050 | U | 2/1951 |
| DE | 9406387 | U1 | 6/1994 |
| DE | 10110835 | A1 | 9/2002 |
| DE | 102008036020 | A1 | 6/2009 |
| EP | 1916468 | A1 | 4/2008 |

* cited by examiner

*Primary Examiner* — Anne Hines

(74) *Attorney, Agent, or Firm* — Yakov Sidorin; Quarles & Brady LLP

(57) ABSTRACT

A lighting device for streets, having a housing for receiving at least one lighting module can be mounted easily if it comprises a plurality of lighting units having a light element and an optical element associated with the same and being fastened on a carrier. The module housing is covered by a sealing pane facing the lighting units and comprises fastening means for removably fastening same on the housing. Electrical contact means are provided on the module housing for electrically connecting the lighting units to an external voltage source, wherein the fastening and contact means are designed such that the lighting module can be brought from an assembled position, in which the lighting module is mechanically and electrically connected to the housing, to a disassembled position in which the lighting module is not mechanically or electrically connected to the housing, and vice versa, exclusively by means of a linear displacement.

10 Claims, 5 Drawing Sheets

STREET LIGHTING DEVICE AND INSTALLATION METHOD

CROSS-REFERENCE TO RELATED APPLICATIONS

The present application is a continuation of pending International Application No. PCT/EP2010/065604 filed on Oct. 18, 2010, which designates the United States and claims priority of German Patent Application No. 10 2009 050 876.7 filed Oct. 27, 2009, which is fully incorporated herein by reference.

This invention relates to a lighting device for streets, walkways and the like, with an enclosure that is positioned at a distance from an area to be lit and serves to accommodate at least one light module consisting of multiple light units, each comprising a carrier-mounted light element and an associated optical element, said multiple light units and the carrier are attached to a common module housing, which module housing is screened by a cover plate facing the main beam direction of the light units and provided with fastening means for its detachable mounting on the housing as well as with electrical contacts for the electrical connection of the light units to an external voltage source.

The invention also relates to a method for installing a light module on the housing of a lighting device.

EP 1 916 468 A1 describes a lighting device for streets and the like, comprising an enclosure with multiple light modules for generating a predefined light distribution. Each of the light modules consists of multiple light units in a linear array, each containing an LED light element and an associated optical element. The LED light elements and optical elements are attached to a common carrier board. The light elements, together with the carrier, are mounted on a common module housing which in the main direction of the light beam is covered by a clear glass plate. That earlier module housing has laterally protruding mounting flanges so that by means of suitable fasteners such as screws it can be detachably mounted on the enclosure of the lighting device. In addition, for the electrical contact the module housing is provided on one end face with a plug connector, permitting the electrical connection of the light units to an external voltage source. The drawback of that earlier lighting device consists in the fact that replacing a light module is relatively complex since, for one, the mechanical mounting and, for another, the electrical contact must be disconnected.

It is therefore the objective of this present invention to introduce a lighting device as well as a method for installing a light module designed to reduce the installation and removal effort when a light module needs to be replaced.

To achieve that objective, this invention, in conjunction with the main claim of patent claim 1, is characterised in that the mounting and electrical contact provisions are designed in a manner whereby a mere linear movement can move the light module from its installed position, in which the light module is mechanically and electrically connected to the housing, into its uninstalled position in which it is not mechanically and electrically connected to the housing, and vice versa.

The particular advantage of this invention lies in the fact that by combining the mounting and contact provisions both the electrical and the mechanical connection is established with only one linear movement. To uninstall the light module it merely needs to be pulled off the housing without additionally requiring an electrical disconnection. For installing the light module, it only needs to be placed in a recess in the housing whereby, upon completion of that linear movement, the light module is mounted on the housing mechanically fastened and electrically connected. This can significantly reduce the installation and removal time.

In one preferred embodiment of the invention, the mounting provisions encompass a number of plug elements and/or detent elements, in which case matching first plug elements and first detent elements of the housing interact with corresponding second plug elements or second detent elements of the module housing. Advantageously, the light module can thus be installed or uninstalled with a mere linear movement. The holding strength of the plug and detent elements is high enough to obviate the need for additional force-locking fasteners such as screws.

In a further development of the invention, the plug elements also comprises electrical contacts, thus creating a functional combination. This achieves a mechanical and an electrical connection at the same time.

In one preferred embodiment of the invention the mounting and contacting provisions are designed in a manner whereby the light module can be brought into at least two installed positions, with these mounting positions differing from one another by the fact that, relative to the housing, the light modules are turned around a rotary axis facing in the main direction of the light beam. In an elongated enclosure or light module housing, provisions can thus be made to allow the light module to be mounted in two installed positions, with one mounting position offset by 180° relative to the second mounting position. Advantageously, it is thus possible to install two identical light modules in different mounting positions, permitting the generation of different light beam characteristics or light distribution patterns as may be required.

In another development of the invention, four first plug elements and four second plug elements are provided so that, connected to an electrical circuit, the light units of the light module can be fed direct current even when the module housing is installed in a position rotated by 180°. Advantageously, this permits a tilting function whereby, in simple fashion, the same light module can be brought into at least two mounting positions relative to the housing. In the electrical circuit an electric compensation is made with regard to the locally separated paired contacts integrated in the plug elements.

In another development of the invention the enclosure and/or the module housing comprises restraining guides so that, especially during the linear mounting movement of the module housing relative to the enclosure, the mounting movement can be self-aligning, allowing the module housing to be brought into the correct predetermined mounting position.

In another development of the invention the enclosure and/or the module housing is provided with mechanical alignment codes, ensuring that during the installation the module housing is mounted in the correct predefined position. This reliably prevents any flawed installation which in the case of an asymmetric light beam of the light module would lead to an undesirable light distribution.

For the solution, the invention, in conjunction with the main claim of patent claim 10, is characterised in that the light module is brought into its mounted position solely by a linear movement, simultaneously establishing a mechanical and an electrical connection between the light module and the housing.

The special advantage of the method according to the invention consists in the fact that, in simple fashion, a mere linear relative movement between the module housing and the enclosure permits secure installation and removal. Additional electrical-contact and fastening provisions are not required, thus significantly reducing the installation and de-installation effort.

The following will describe an exemplary embodiment of this invention in more detail with the aid of the attached drawings in which.

Figure 1:
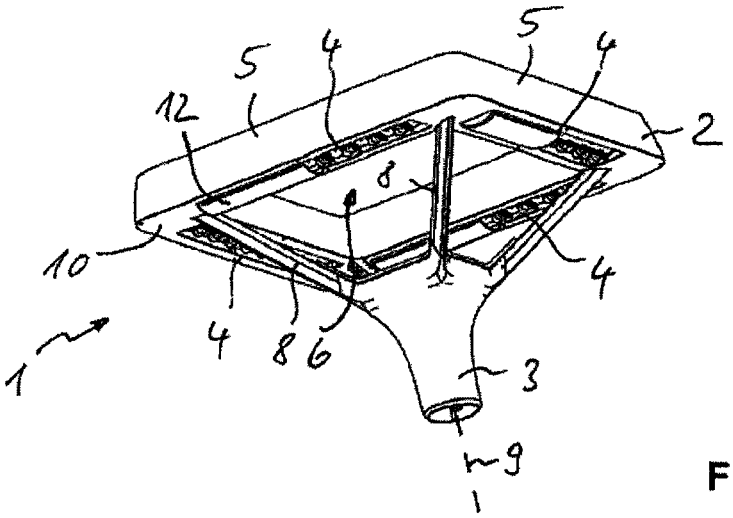
FIG. 1 is a perspective bottom view of a lighting device with light modules mounted in a frame-shaped configuration.

A lighting device 1 for streets, walkways and the like includes a frame-shaped enclosure 2 which by way of a base 3 connects to a post, not illustrated. The enclosure 2 is positioned at a predefined distance from an area to be illuminated (street, walkway etc.). Together with its base 3, the lighting device 1 is mushroom-shaped.

The lighting device 1 is of a segmented design, consisting of multiple straight-linear light modules 4 individually positioned on a frame side 5 of lighting device 1. The frame sides 5 of lighting device 1 delimit a square opening 6. Extending from corner areas of the thus created frame-shaped enclosure 2 are support brackets 8 at an angle of about 45° relative to the axis of the post or axis of symmetry 9 of lighting device 1. On a bottom side 10 the frame-shaped enclosure 2 is provided with four recesses 11, each located on a frame side 5. Each recess 11 accommodates a light module 4 and is protected by a transparent cover plate 12.

Figure 3:
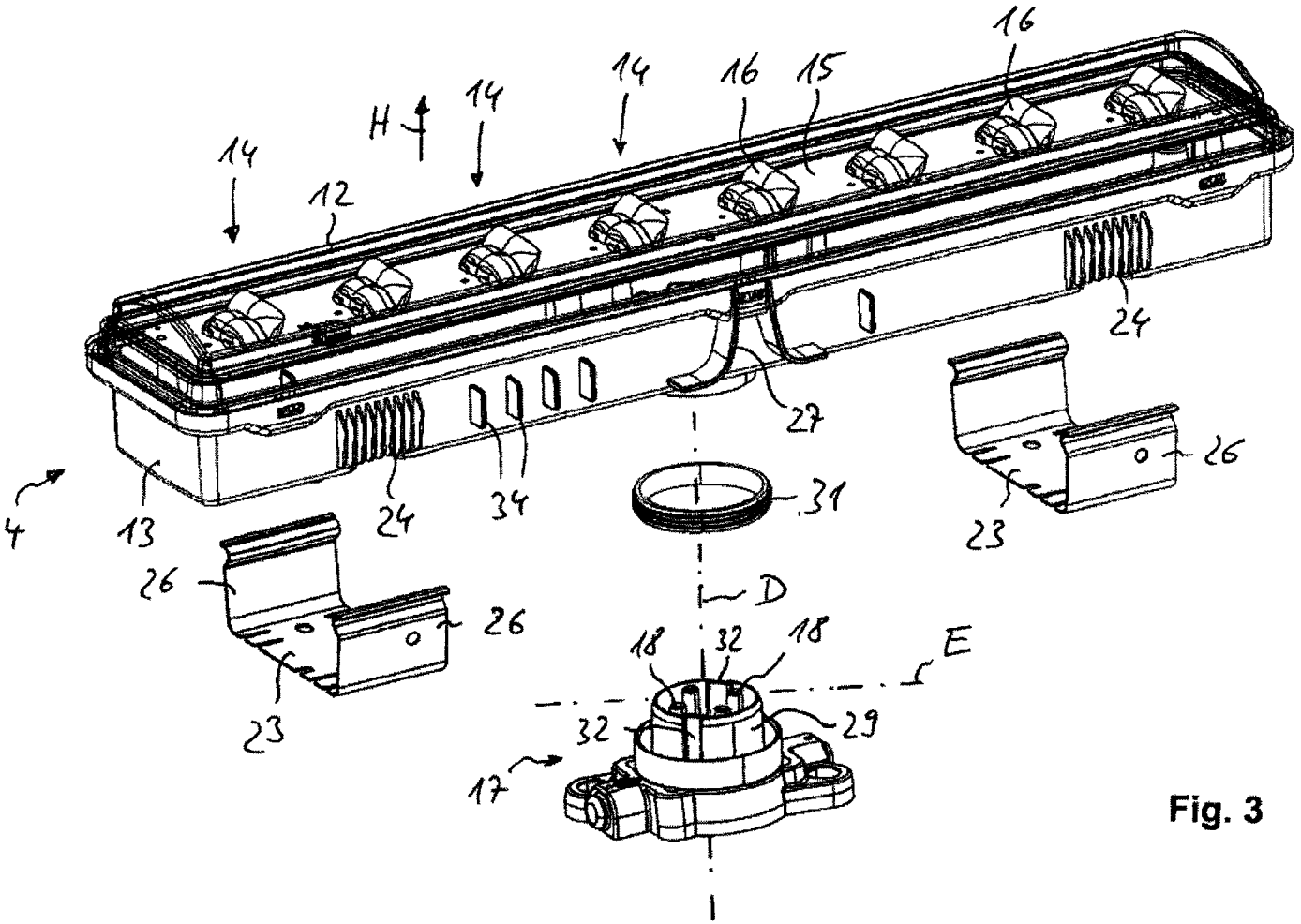
FIG. 3 is an exploded view of the light module and of the mounting/plug elements of the housing.
Figure 4:
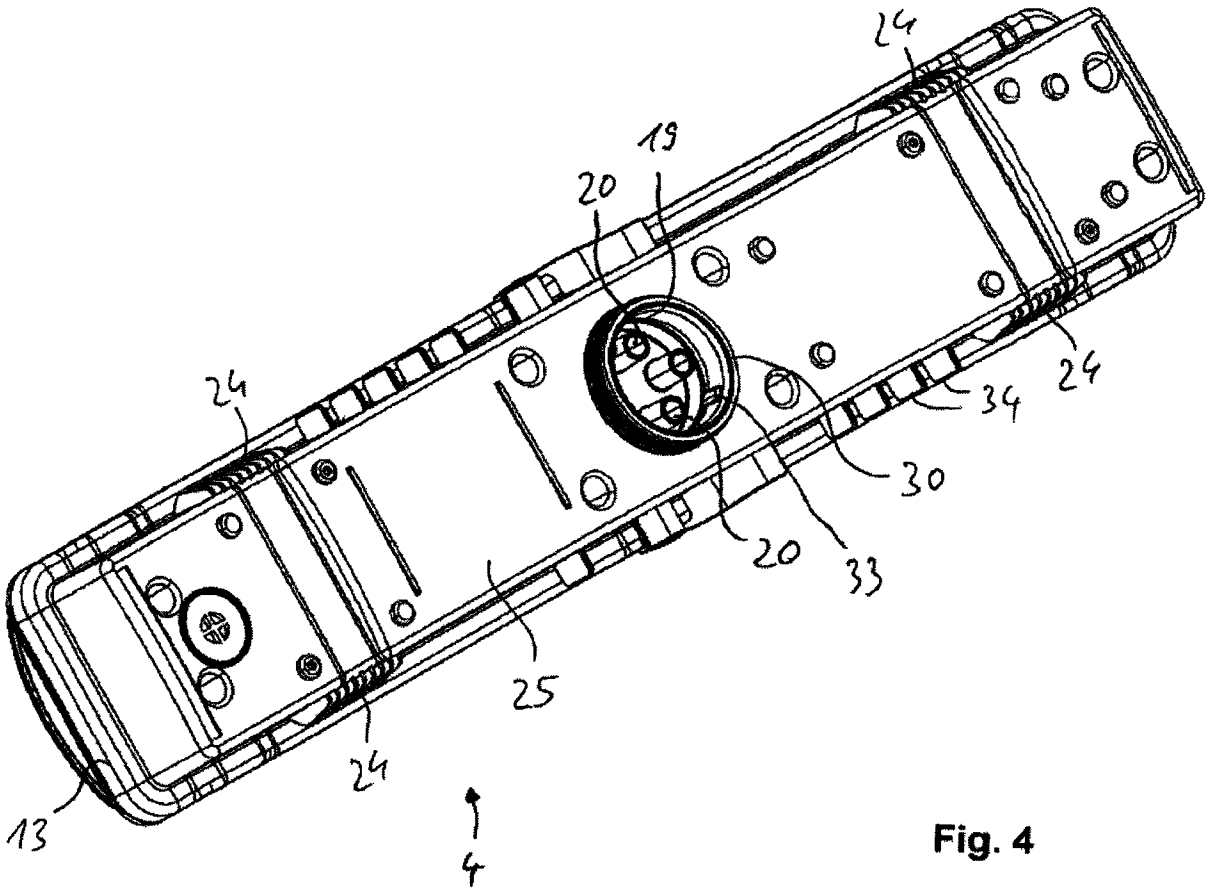
FIG. 4 is a perspective view of a plug-in side of the light module facing the housing.

As can be seen more clearly in FIG. 3, light module 4 includes a pan-shaped module housing 13 to which a carrier board 15 is attached, holding multiple light units 14. The carrier board 15 is in the form of a carrier board or a printed circuit board. All light units 14 encompass light-emitting diodes (LED light element, LED chip) in front of which, in the direction of the main beam H, an optical element 16 is positioned. Optical element 16 is in the form of a conchate lens that produces an asymmetric light distribution pattern. The light units 14 are arranged in a row and, accordingly, the carrier board 15, cover plate 12 and module housing 13 are elongated in shape.

Light module 4 is held in place in the recess 11 of enclosure 2 essentially by positive interlocking, with a linear movement sliding light module 4 from a detached position, in which it is not mechanically and electrically connected to the enclosure 2, into a mounted position in which the light module 4 is mechanically and electrically connected with enclosure 2, and vice versa.

For the attachment, enclosure 2 is provided with a socket 17 with a number of first plug elements 18 as well as module housing 13 and, on a bottom side facing away from carrier board 15, a second socket 19 with a number of second plug elements 20. On a recessed receptacle 21 of enclosure 2 the first socket 17 is attached via a screw connection 22. The first socket 17 and, respectively, the second socket 19 are located in a central area of the elongated recesses 11 and of the corresponding light modules 4.

Additional seating elements provided in enclosure 2 are in the form of detents 23 positioned on opposite sides of and at a distance from the first socket 17. Module housing 13 is provided with second detents 24 which interact with the first detent 23 and are in the form of detent ridges laterally protruding from module housing 13. In the outer region in the longitudinal direction of enclosure 2 the first detents 23 and the second detents 24 are located at a distance from the first socket 17 and, respectively, the second socket 19.

Integrated into the dome-shaped first plug element 18 and the second plug element 20 are electrical contacts, so that the plug elements 18, 20 also constitute conductors for the electrical connection between light module 4 and enclosure 2.

For mounting light module 4 in the recess 11 of enclosure 2, light module 4, with a bottom side 25 of module housing 13, is set against the edge of recess 11 and is then inserted, with a straight-line movement perpendicular to receptacle 21 and bottom side 25, into recess 11 until by plug-in and/or detented connection of the corresponding first socket 17 and the second socket 19 and, respectively, the first detents 23 and the second detents 24, both a mechanical and an electrical connection between light module 4 and enclosure 2 has been established.

The first detents 23 are in the form of retaining clips, screw-mounted on receptacle 21 of enclosure 2. The retaining clips 23 have springy legs 26 which in the mounted position of module housing 13 snap around detents 24.

As a positive guide for the mutual alignment of the first plug elements 18 and the second plug elements 20 the module housing 13 is laterally provided with funnel-shaped, sloped starter surfaces 27, while on the inside, enclosure 2 has tapered guide ridges 28. The first socket 17 and the second socket 19 are provided with a circular surface 29, 30, tapered in the mounting direction, thus permitting module housing 13 to be seated in a defined mounting position.

A circular gasket 31 is positioned between the first socket 17 of enclosure 2 and the second socket 19 of module housing 13. Moreover, light module 4 is a sealed unit that can be used for instance in wet rooms, explosion-protected rooms, refrigeration areas and the like. The straight-line insertion and removal of light module 4 into/from enclosure 2 permits a significant reduction of the installation effort. In particular, light module 4 can be exchanged while in a live state. Electric safety is ensured by protected, unexposed contact elements.

Figure 2:
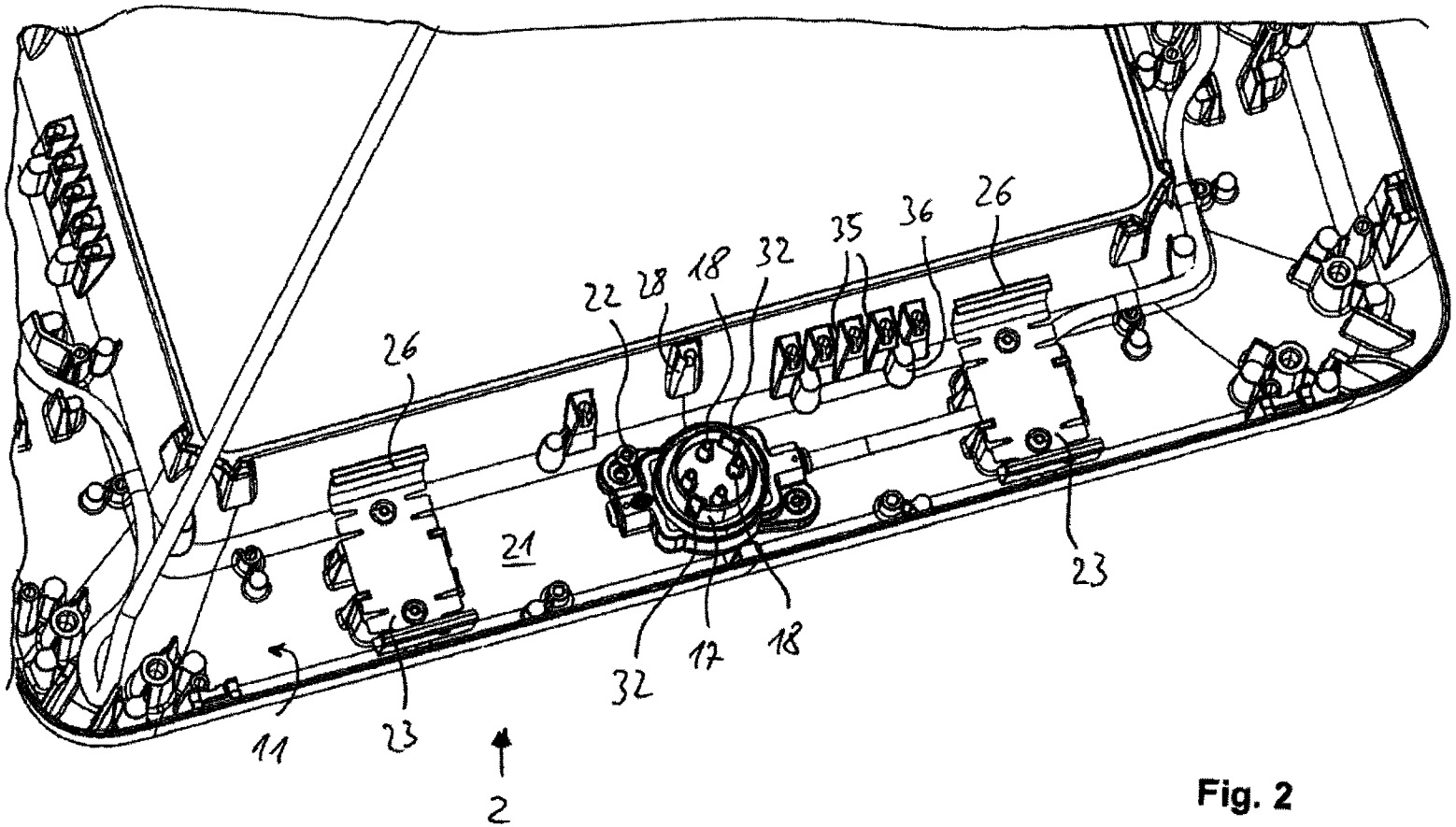
FIG. 2 is a partial top view of a mounting side of the frame in the absence of a light module.

In the absence of these axial indentations 32 or axial prominences 33 or if they are of the same width, alignment codes may be provided on the side of module housing 13 in the form of code ridges 34 protruding from the side wall of module housing 13 at a predefined distance from one another. A vertical side wall of enclosure 2, rising from receptacle 21, is provided with corresponding slots 35 in which engage the matching code ridges 34 in the mounting position. Depending on the specified 0° or 180° mounting position these slots 35 are provided with appropriate blocks 36 so that the corresponding code ridge 34 cannot engage in the respective slot 35 when module housing 13 is in the wrong mounting position. As can be seen in FIG. 2, two inner slots 35 are free while the two outer slots 35 are barred by blocks 36. For the correct positioning of module housing 13 the latter may have on its matching side only two inner code ridges 34 while the outer ones must be removed.

Figure 5:
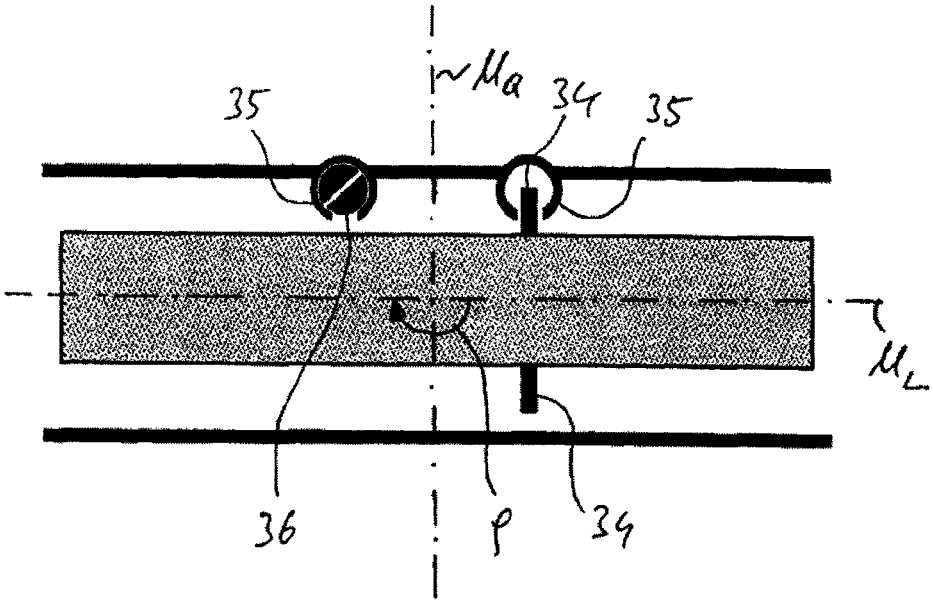
FIG. 5 is a schematic illustration of the light module installed in the frame, with alignment codes laterally provided on the light module.

FIG. 5 shows an example of the requirements that must be met to ensure that light module 4 is seated in the correct mounting position. The code ridge 34 must be able to engage in a matching slot 35 of enclosure 2 in the form of an open screw boss. A screw boss on the opposite side of the transverse central plane $M_Q$ is provided with a screw-type block 36, preventing a mounting position offset by 180°. Changing screw 36 over into the other screw boss 35 will permit the installation of light module 13 in a mounting position rotated by 180°.

Evidently, depending on the shape of light module 4 and enclosure 2, by suitably placing the plug elements 18, 20, positioned in a distributed arrangement along plane E that extends perpendicular to the main beam direction H, it is possible to obtain different, or more, mounting positions at angles of rotation that differ from the design example described.

List of Reference Numbers

| | | | |
|---|---|---|---|
| 1 | lighting device | 29 | circular surface |
| 2 | frame-shaped enclosure | 30 | circular surface |
| 3 | base | 31 | circular gasket |
| 4 | light module | 32 | axial indentation |
| 5 | frame side | 33 | axial prominence |
| 6 | opening | 34 | code ridges |
| 7 | | 35 | slots |
| 8 | bracket | 36 | blocks |
| 9 | post axis of symmetry | E | plane |
| 10 | bottom side | H | main beam direction |
| 11 | recess (2) | $M_Q$ | transverse central plane |
| 12 | cover plate | $M_L$ | longitudinal central plane |
| 13 | module housing | $\phi$ | angle of rotation |
| 14 | light units | | |
| 15 | carrier board | | |
| 16 | optical element | | |
| 17 | first socket | | |
| 18 | first plug elements | | |
| 19 | second socket | | |
| 20 | second plug elements | | |
| 21 | receptacle | | |
| 22 | screw connection | | |
| 23 | first detent | | |
| 24 | second detent | | |
| 25 | bottom side | | |
| 26 | leg | | |
| 27 | funnel-shaped sloped starter surface | | |
| 28 | guide ridges | | |

The invention claimed is:

1. A lighting device for streets and walkways, with an enclosure that can be positioned at a distance from an area to be lit and that serves to accommodate at least one light module, wherein said light module comprises multiple light units, said light module comprises a light element with an associated optical element, the latter being mounted to a support, said multiple light units and the support are positioned on a common module housing, said module housing is provided with a cover plate on a side of the light module pointing in a direction of a main light beam of the multiple light units, the module housing comprises fastening means for detachable mounting of said module housing on an enclosure, the module housing being provided with electrical contacts for electrical connection of the light units to an external voltage source, the fastening means and the electrical contacts are configured such that the light module can with merely a linear movement be brought from an installed position, in which it is mechanically and electrically connected to the enclosure, into an uninstalled position in which the light module is not mechanically and electrically connected to the enclosure, and vice versa.

2. A lighting device as in claim 1, wherein the fastening means includes a number of plug elements and/or detents, with a first plug element and/or a first detent positioned in a recess of the enclosure for accommodating the light module, while a second plug element and/or a second detent is molded or attached to said module housing.

3. A lighting device as in claim 2, wherein the first plug element of the enclosure and the second plug element of the module housing are each provided with electrical contacts serving as conductors so that, in the installed position of the light module, the first plug element and the second plug element establish mechanical and electrical connections.

4. A lighting device as in claim 3, wherein the first plug element and the second plug element are distributed over a plane that extends perpendicularly to the main beam direction, in a manner whereby, with the mutual mechanical and electrical connections established between the first plug element and the second plug element, it is possible with a linear movement to bring the light module into a second mounting position in which, around an axis of rotation extending in the main beam direction, the light module is placed in an installed position that is rotationally offset from a first mounting position by a predefined angle of rotation.

5. A lighting device of claim 2, wherein the recess of the enclosure and the light module are of an elongated configuration, with the first plug element and the second plug element positioned in a central area of the enclosure and of the light module, while the first detent of the enclosure and the second detent of the light module are located in an outer region extending in a longitudinal direction of the enclosure at a distance from said central area.

6. A lighting device of claim 2, wherein the first detent is in the form of a retaining clip, attached to the enclosure, which interacts with the second detent laterally protruding as detent lugs from the module housing.

7. A lighting device of claim 1 wherein at least four first plug elements of the enclosure and at least four second plug elements of module housing are provided as the fastening means, and incorporating electrical circuitry in a manner whereby in the case of a different connection between a pair of first plug elements and a pair of second plug elements direct current voltage is supplied to the multiple light units in both a first mounting position and a second mounting position of the light module.

8. A lighting device of claim 1, wherein at least one of the enclosure and the module housing comprises positive guides for the controlled guiding of the module housing into its mounting position in the enclosure.

9. A lighting device of claim 1, wherein at least one of the enclosure and the module housing is provided with mechanical alignment codes for ensuring a correct mounting position of the module housing.

10. A method for mounting a light module in an enclosure of a lighting device according to claim 1, whereby the light module is brought into its mounted position with a mere linear movement while at the same time establishing mechanical and electrical connections between the light module and the enclosure.

* * * * *